United States Patent [19]

Crossman

[11] Patent Number: 4,864,758

[45] Date of Patent: Sep. 12, 1989

[54] BOX MAGAZINE AND SHELL DRIVE SYSTEM FOR SHOTGUNS

[75] Inventor: Douglas P. Crossman, Lexington, S.C.

[73] Assignee: Whitehawk Corporation, Lexington, S.C.

[21] Appl. No.: 115,989

[22] Filed: Nov. 2, 1987

[51] Int. Cl.[4] ..... F41C 7/00

[52] U.S. Cl. ..... 42/18; 42/49.01

[58] Field of Search ..... 42/6, 17, 18, 49.01, 42/50; 89/33.03, 33.05, 33.1, 47

[56] References Cited

U.S. PATENT DOCUMENTS

| | | | |
|---|---|---|---|
| 2,114,821 | 4/1938 | Thomas | 42/17 |
| 3,019,542 | 2/1962 | Manthos | 42/18 |
| 3,130,638 | 4/1964 | Horton, Jr. et al. | 89/33.1 |
| 3,505,927 | 4/1970 | Driscoll | 89/33.1 |
| 3,667,147 | 6/1972 | Goldin et al. | 89/33.03 |
| 3,736,839 | 6/1973 | Childers | 89/33.03 |

*Primary Examiner*—Deborah L. Kyle
*Assistant Examiner*—Richard W. Wendtland
*Attorney, Agent, or Firm*—B. Craig Killough

[57] ABSTRACT

Disclosed herein is a magazine for repeating shotguns, which may be incorporated into existing repeating shotguns, comprising a box type magazine which intersects the magazine of the shotgun so as to receive shells into the magazine tube from the magazine, and a shell drive assembly which traverses the magazine tube so as to position a shell which has entered the magazine tube into a firing chamber. This invention incorporates the manual action slide of a manual, or pump, shotgun to actuate the shell drive assembly, and uses the gas pressure actuation means of an automatic shotgun to provide movement of the shell drive assembly.

10 Claims, 5 Drawing Sheets

BOX MAGAZINE AND SHELL DRIVE SYSTEM FOR SHOTGUNS

BACKGROUND OF THE INVENTION

This invention relates to firearms generally, shotguns more specifically, and is particularly related to a box type magazine which may be incorporated into existing shotguns, manual or automatic, having conventional means of positioning shells into the firing chamber from a magazine tube.

Repeating shotguns of the type commonly in use are typified by a magazine tube which runs generally parallel underneath the barrel of the shotgun. By means of spring biasing, the shells are advanced through the magazine into position underneath the firing chamber. On a manual, or pump type, shotgun, a slide advanced rearwardly actuates a mechanism to cause the fired shell to be ejected from the firing chamber, and the next shell, which has been placed in position in the magazine tube underneath the firing chamber by spring biasing, is lifted and positioned into the firing chamber by a mechanism which is actuated as the slide is advanced forwardly. Automatic shotguns function in the same manner, with gas pressure released from the firing of the shell being used to actuate the mechanism to eject the spent shell and to actuate the mechanism to place the next shell from the magazine into firing position.

Substantially all shotguns in the prior art incorporate a tube type magazine and work on the principle set forth above. The present invention is a box type magazine which may be used in conjunction with the mechanism used in existing repeating shotguns which incorporate a tube type magazine, and may be adapted to existing shotguns as will be seen herein.

The advantage of a box type magazine is that the shells may be preloaded into a box type magazine, with magazines changed quickly and easily during the use of the gun. With tube type magazines, it is necessary to load shells one at a time through a loading gate. To unload unspent shells, it is necessary to work the shells individually through the action of the gun. In the present invention, the empty magazine may be quickly removed from the gun, and a new magazine having shells therein quickly put in its place. Reload time for a magazine type shotgun is therefore drastically reduced over that for a tube magazine shotgun. Further, more shells may be held in box type magazine than in a tube type magazine. Greater safety is attained by unloading all unspent shells in the magazine at one time.

SUMMARY OF THE INVENTION

The present invention comprises a housing 4 which is mounted to the magazine tube 6 just ahead of and below the firing chamber 18. A box type magazine 8 having shells 10 located therein which are advanced by spring biasing is mounted to the housing.

Within the magazine tube 6 is located a shell drive assembly 16. This shell drive assembly traverses the magazine tube 6 and is advanced rearwardly by pump action or by gas pressure, depending on whether the shotgun is manual or automatic, and enters the housing so as to contact a shell **10*a* which has been advanced to the top of the magazine hood 5, and forces the shell rearwardly into position just under the firing chamber, so that the shell can be received by the elevator mechanism 20 which places the shell into the firing chamber 18. The shell drive assembly 16 is then forced forward by the action slide 14, so that it exits the housing, allowing a new shell 10*b* to be advanced upward into the magazine hood 5. The shell drive assembly 16 in the preferred embodiment comprises a cylinder 24 having a spring biased piston 26** therein as will be seen.

DETAILED DESCRIPTION OF THE DRAWINGS

Figure 1:
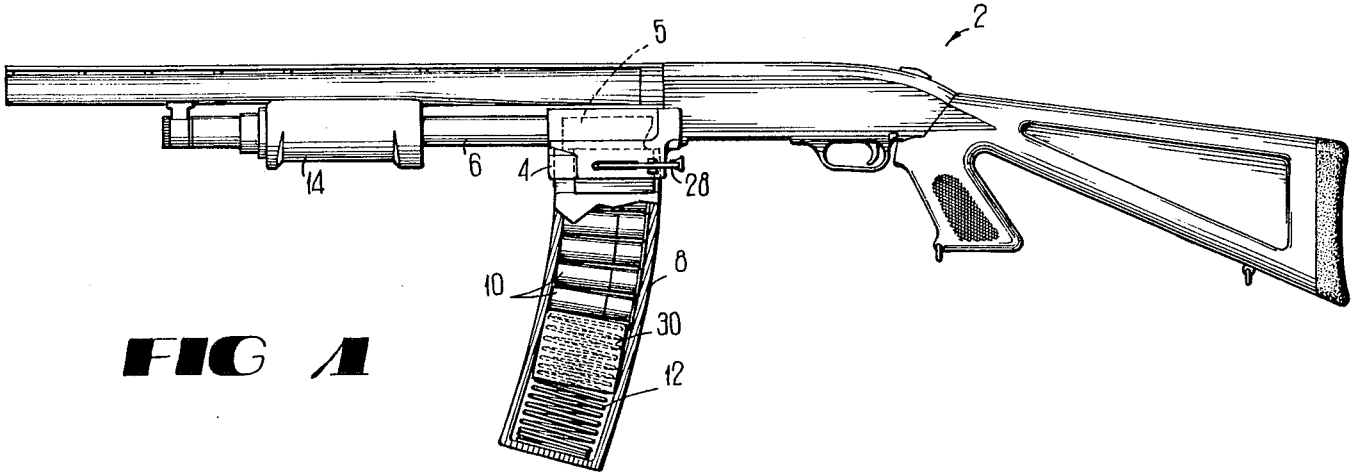
FIG. 1 is a side elevation of a shotgun having the box magazine and housing mounted thereto.

FIG. 1 is a side elevation of the shotgun 2 showing housing 4 mounted to magazine tube 6 and box magazine 8 mounted to the lower portion of housing 4, and showing box magazine 8 as a sectional view to reveal spring biasing means 12 of advancing shells 10 through box magazine 8, into housing 4 and subsequently into magazine hood 5. Also shown is the action slide 14.

Figure 2:
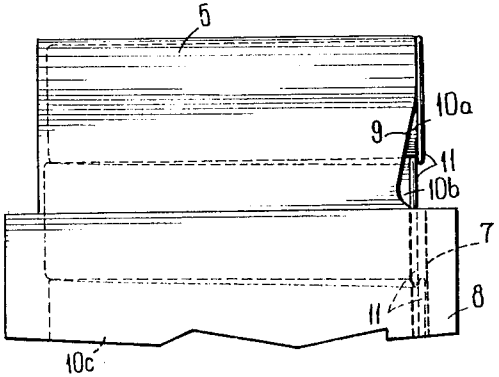
FIG. 2 is an enlarged isolation showing the housing with a shotgun shell having been advanced to the top of the magazine hood, and showing the positioning of the shells within the magazine hood.

FIG. 2 is an enlarged, fragmentary isolation showing housing 4 with shells 10 therein which have advanced from the box magazine into the magazine hood 4 as phantoms, and particularly showing the positioning of the shells by means of the rim channel 7 and the magazine hood 5.

Figure 3:
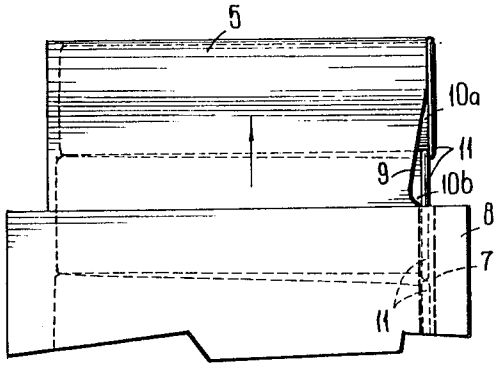
FIG. 3 is substantially the same view as FIG. 2, showing the direction of travel of the shotgun shell through the magazine into the magazine hood.

FIG. 3 is substantially the same view as FIG. 2, with an arrow indicating the direction of travel of shells 10 into magazine hood 4.

Figures 4, 5:
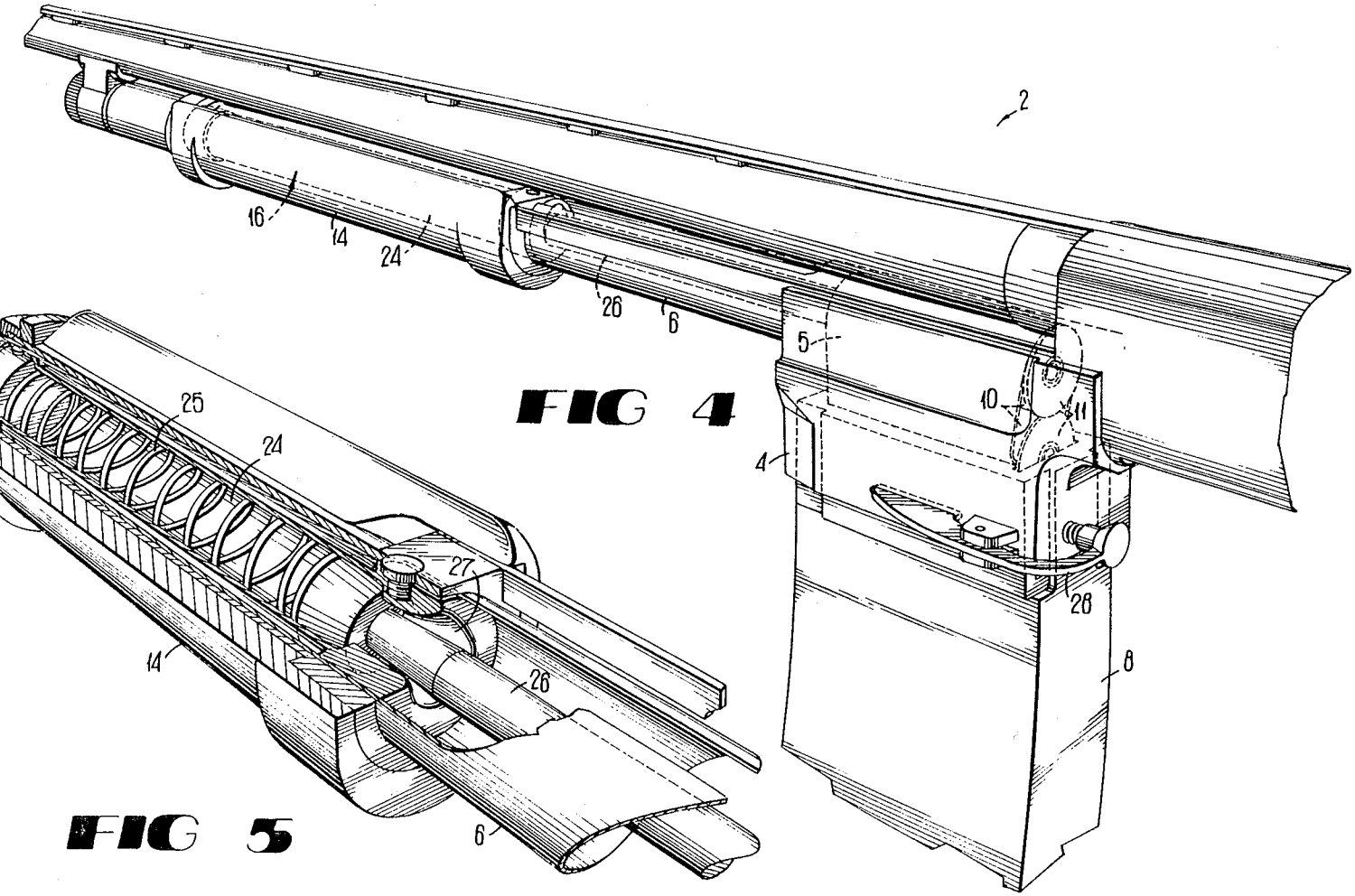
FIG. 4 is a partial, perspective view showing the shotgun with the housing mounted thereto and a portion of the magazine, with the shell drive assembly and shells shown as a phantom.
FIG. 5 is a perspective isolation of the shell drive assembly.

FIG. 4 is a perspective view isolating magazine tube 6, housing 4, a portion of box magazine 8, the mechanism 28 for releasing box magazine 8 from magazine hood 5, action slide 14 on a manual or pump type shotgun and, as phantoms, shells 10 which have advanced into magazine hoods, and shell drive assembly 16.

FIG. 5 is an enlarged perspective isolation of the shell drive assembly and action slide, being partially sectioned so as to show the internal mechanism of the shell drive assembly. Shown are piston 26 which travels in and out of cylinder 24, with piston 26 being spring biased by spring 25. The conical void 27 is shown which allows the piston additional movement. The cylinder of the shell drive assembly is shown as being attached to the action slide by means of a screw.

Figure 6:
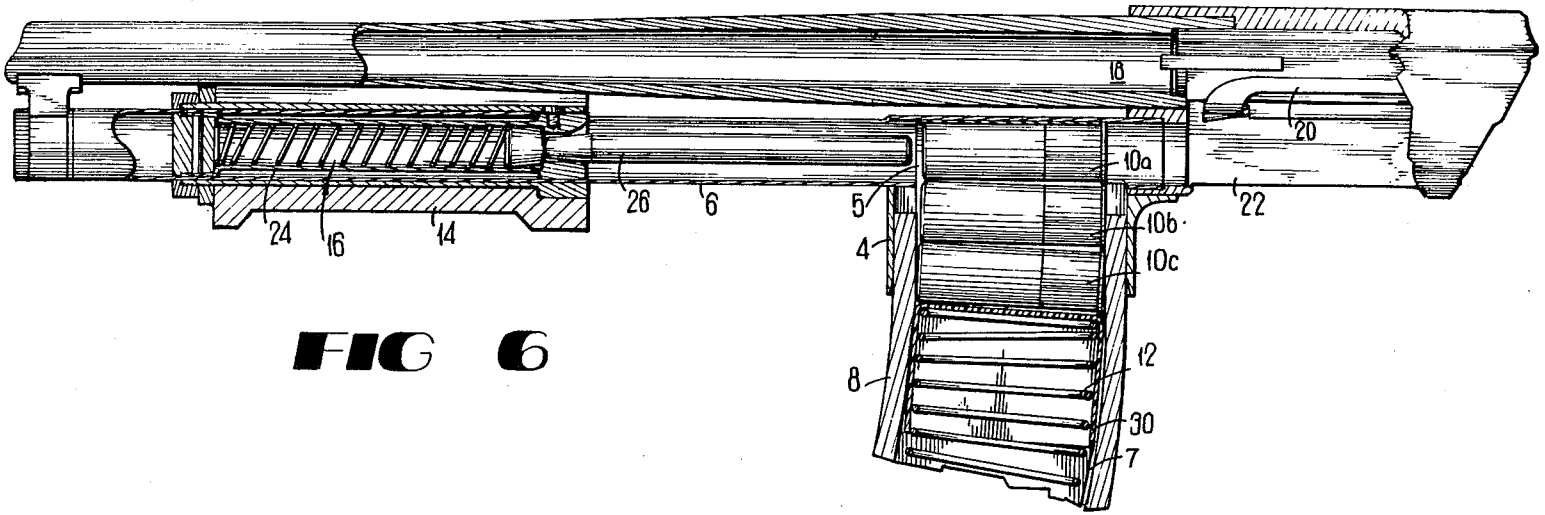
FIGS. 6, 7, 8, 9, 10 and 11 are enlarged, partial views showing the same side of the shotgun as FIG. 1, being partially sectioned in a longitudinal fashion to show the action of the invention through the loading cycle.

FIG. 6 shows firing chamber 18, elevator means 20, loading chamber 22, magazine tube 6, housing 4, box magazine 8, and spring biasing means 12 for advancing shells **10*a*, *b*, *c*. Shell drive assembly 16 is shown comprising cylinder 24 and spring biased piston 26. Action slide 14** is shown as is used with a pump, or manual, type shotgun.

Figure 7:
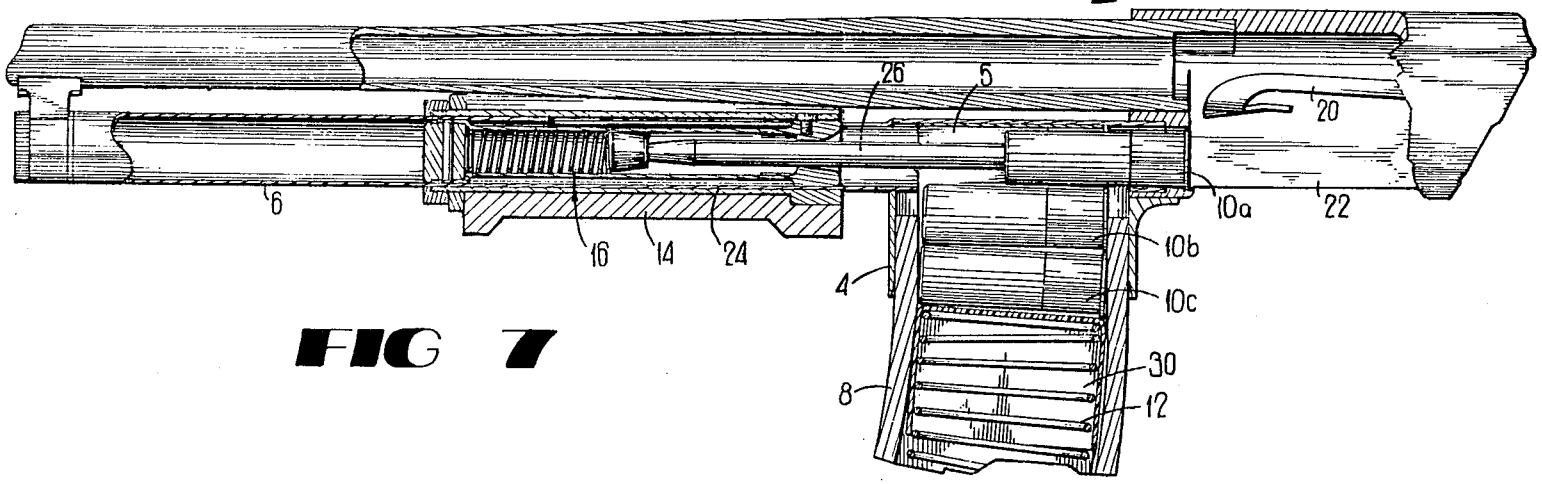

FIG. 7 is substantially the same as FIG. 6, but shows action slide 14 as it begins to advance rearwardly, advancing shell drive assembly 16 and causing piston 26 to contact shell 10*a* which has advanced to the top of magazine hood 4.

Figure 8:
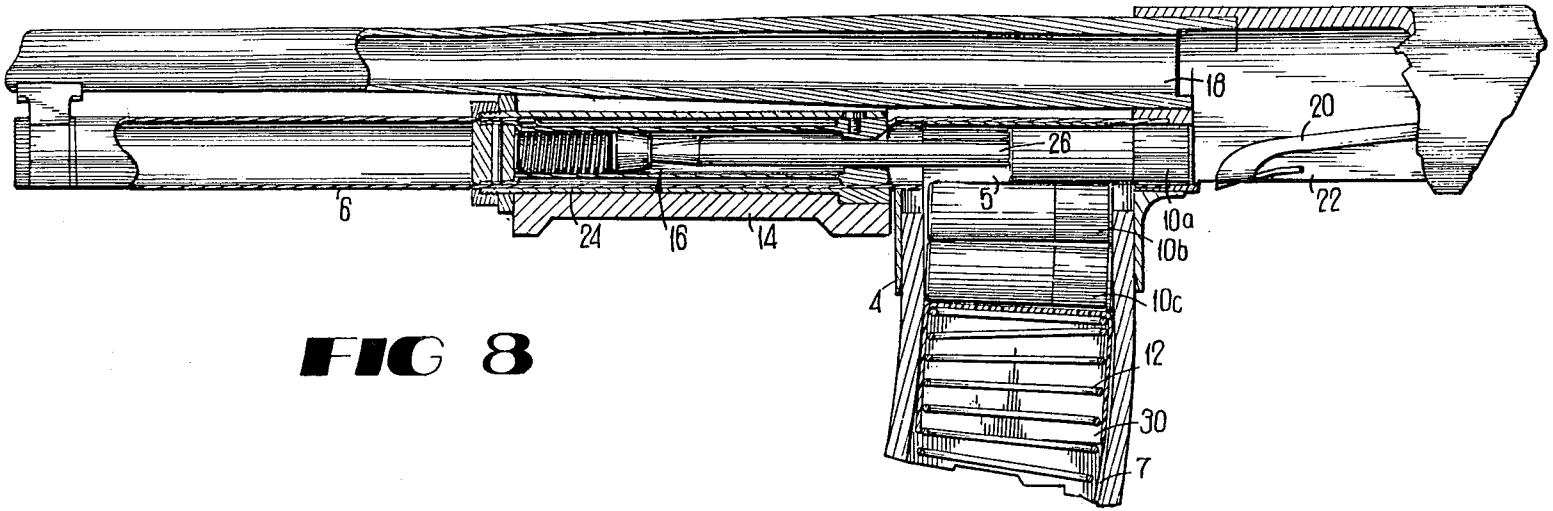

FIG. 8 is substantially the same as FIG. 7, showing a further rearward progression of action slide 14 and the shell drive assembly 16, and showing shell 10*a* as it is advanced toward the loading chamber by piston 26 of shell drive assembly 16.

Figure 9:
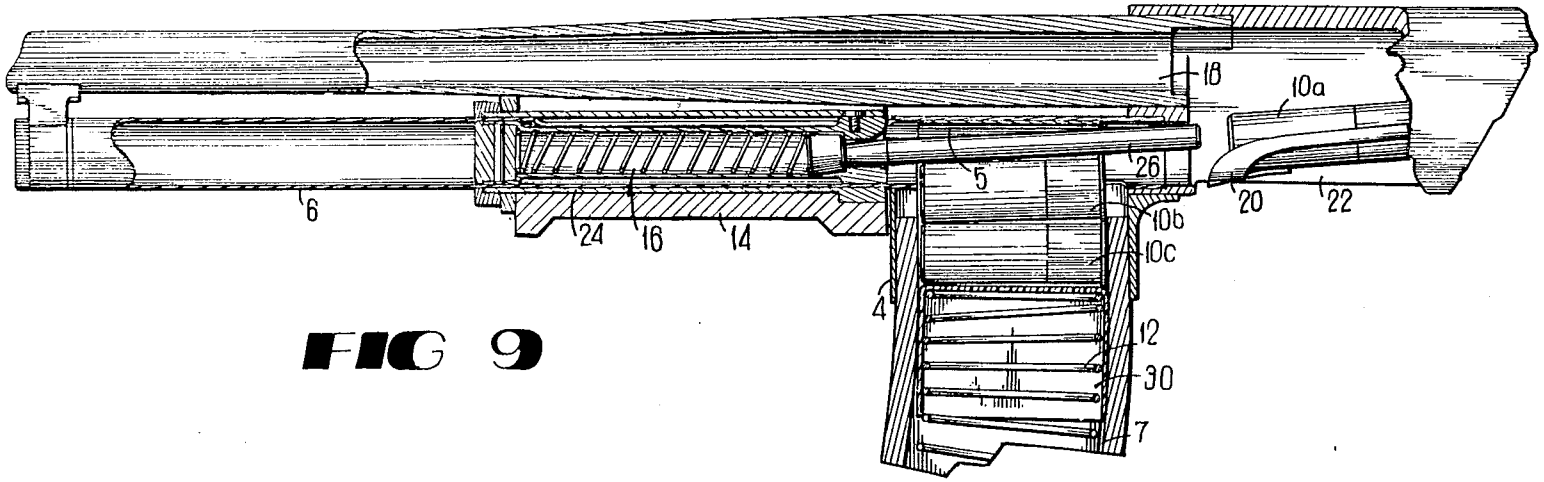

FIG. 9 is substantially the same as FIG. 8, and shows shell 10*a* after it has been placed into position within loading chamber 22 and as it begins its upward advancement into firing chamber by means of elevator 20.

Figure 10:
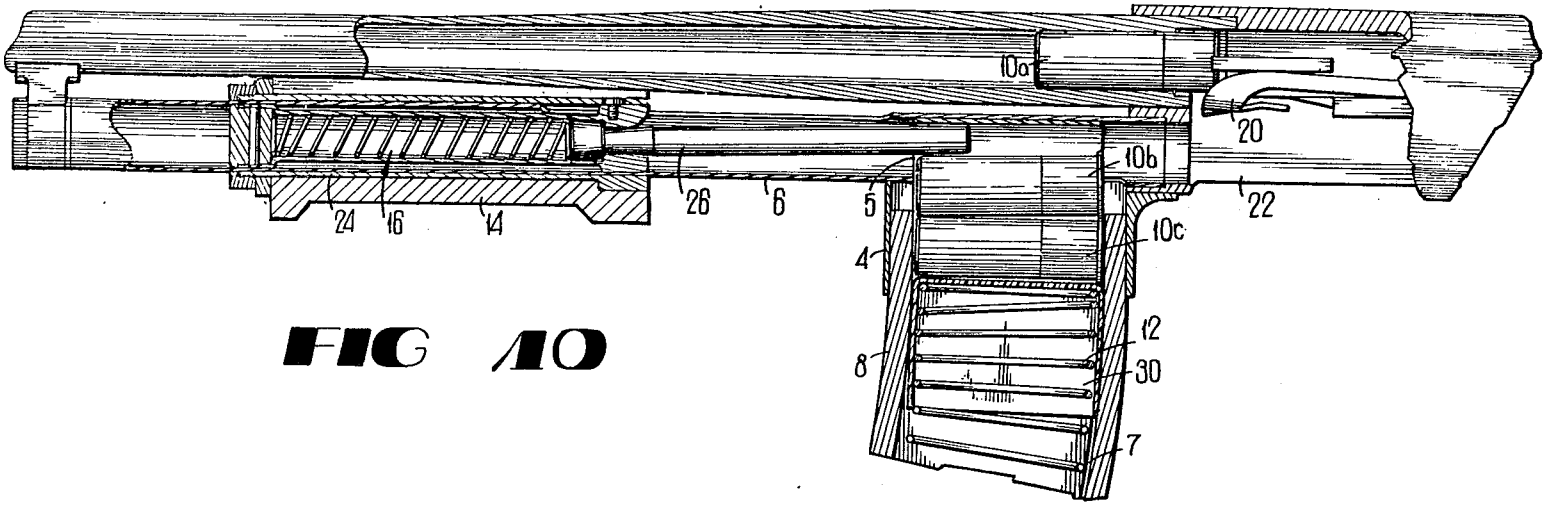

FIG. 10 is substantially the same as FIG. 9, showing the shell 10*a* which has been placed into position within firing chamber 18, and showing action slide 14 as it is advanced forwardly, taking with it shell drive assembly 16.

Figure 11:
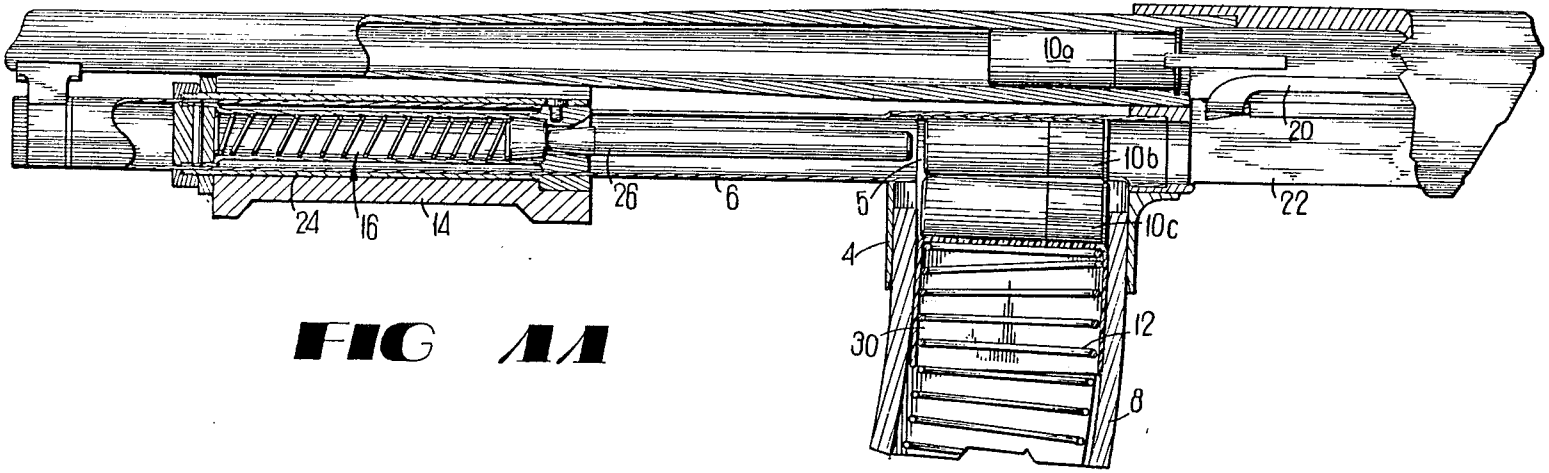

FIG. 11 is substantially the same as FIG. 10, showing action slide 14 as it has advanced to its full forward position, with piston 26 of shell drive assembly 16 having exited magazine hood 4 so as to allow shell 10*b* within magazine 8 to advance to the top of magazine hood 4 by spring biasing means 12.

DETAILED DESCRIPTION OF THE PREFERRED EMBODIMENT

The present invention provides a box magazine or cartridge which can be used in conjunction with shotguns of the type which are currently in widespread use, and provides a means for holding a relatively large number of shells, while being easily replaceable when empty with a loaded magazine for quick reloading of the shotgun. This invention may be adapted to most existing shotguns, or could be incorporated into a shotgun as an original design.

The vast majority of repeating shotguns currently in use incorporate a magazine tube which runs parallel to the barrel of the gun. Shells are placed end to end within the magazine tube, and are advanced toward an elevator means by spring biasing means. As the gun is fired, either by manual means or by automatic means as a result of gas released from the firing of the shell, the fired shell is ejected and the elevator causes the most rearwardly advanced shell to be lifted into the firing chamber.

The present invention incorporates the use of the elevator means as described herein, which is found in most repeating shotguns existing in the prior art. The present invention provides a box magazine or cartridge which is mounted to the gun in a generally perpendicular fashion relative to the magazine tube and barrel. While spring biasing is used within the box magazine to advance the shells into the magazine tube, the spring biasing means found in the magazine tube of the prior art is not suitable for advancing the shell from the magazine tube into position so that the elevator can position the shell into the firing chamber.

The preferred embodiment shown in the drawings depicts a pump type, or manual, shotgun 2 to which the invention has been adapted. It should be kept in mind that automatic shotguns work on the same principle of using a magazine tube and elevator to position the shell into the firing chamber, and that the present invention may be adapted to automatic shotguns in the same fashion as disclosed herein. Accordingly, either an automatic or pump action (manual) shotgun could be designed to originally include the present invention, whether such shotgun be pump action (manual) or automatic.

The present invention provides a box magazine or cartridge 8 into which shells 10 are placed, a housing 4 or similar means for mounting the box magazine 8 in a quick release fashion to the shotgun, a means 12 for advancing the shells 10 from the box magazine 8 into the magazine hood 5 and magazine tube 6, and a means 16 for advancing a shell 10 from the magazine hood 5 into the magazine tube 6 and loading chamber 22 for loading of the shell 10 by the elevator 20 into the firing chamber 18 as desired by the operator.

In the preferred embodiment, as can be seen in FIG. 1, a box magazine 8 is mounted to a shotgun in a generally perpendicular fashion to the magazine tube 6. A number of shells 10 are placed within the box magazine 8, with the shells 10 being stacked on top of each other in the manner as shown in FIG. 1. Box magazine 8 is attached by means of a housing 4 to the magazine tube 6 just ahead of the elevator 20 and firing chamber 18. Shells 10 are advanced to the top of the magazine hood 5 by spring biasing means 12, and as shown, a follower 30 is used to contact the shells 10, with the follower 30 advancing the shells 10 upwards by means of the relatively large spring 12 located underneath it. The particular curvature of the box magazine as seen from the side aids in advancement of the shells 10 through magazine 8, and prevents jamming of the shells as they enter the magazine hood 5.

Housing 4 is used to attach the box magazine 8 to the magazine tube 6. Housing 4 attaches to the magazine tube 6, and is positioned just ahead of the elevator 20 and firing chamber 18 as can be seen in the drawings. A slot or other void is formed within the lower surface of the magazine tube 6 at the point that the housing joins the magazine tube 6, with the slot or void being of sufficient size so as to receive the magazine hood 5 into the magazine tube 6.

As can be seen in FIGS. 2 and 3, the shells 10 are advanced to the top of the magazine hood 5 by the spring biasing means. The direction of travel of the shells 10 to the top of the magazine hood 5 is shown in FIG. 3. The rim channel 7 and the cam surface 9 of magazine hood 5 aid in positioning of the shells 10 as they advance to the top of hood 5 so as to prevent the jamming of the shells. The rim channel 7 keeps the rims 11 of the shells 10 resting on top of each other, rather than the rims 11 resting on the shell itself. The cam surface 9 of hood 5 then forces the shell slightly rearwardly as it reaches the top of hood 5 so that the rim 11 of the uppermost shell 10*a* is rearward (to the right in FIGS. 2 and 3) of the rim 11 of the next lower shell 10*b*. As the uppermost shell 10*a* is pushed rearwardly from the hood 5 by shell drive assembly 16, the shell 10*a* will not jam due to the positioning of its rim 11 relative to the positioning of the rim of shell 10*b* as accomplished by the rim channel 7 and the cam surface 9 of hood 5. The stacking of the shells in this manner is facilitated by the curvature of box magazine 8.

The box magazine 8 should be attached to the housing 4 by quick release means 28. In this fashion, empty magazines may be replaced with loaded ones in a rapid fashion. Virtually any quick release means could be used which will allow the attachment of the rectangular opening of the housing 4 to join with the rectangular opening of the housing 4.

In the prior art, shells 10 are advanced through the magazine tube 6 in a linear fashion toward the elevator 20. The present invention requires that the shells advance toward the magazine tube 6 in a perpendicular fashion, and that the shells 10 then change direction so as to advance rearwardly toward the elevator 20. Accordingly, the shell drive assembly 16 which will be discussed is of primary importance to the invention.

As shown in FIGS. 6 through 11, the shell drive assembly 16 is located within the magazine tube 6. The shell drive assembly 16 must be capable of traversing the magazine tube 6 so as to advance the shell 10*a* which has reached the top of hood 5 in a rearward fashion for positioning by the elevator 20 into the firing chamber 18. The shell drive assembly 16 must also allow the next shell 10*b* to advance to the top of the hood 5 from the box magazine 8 after a shell 10*a* has been loaded into the firing chamber 18. All of this action by the shell drive assembly 16 must take place within the normal action of ejection and loading of the shell as actuated by the means currently found in pump action (manual) and automatic shotguns.

As incorporated into a pump action (manual) type shotgun as shown in the drawings, the shell drive assembly 16 is attached to the action slide 14. Movement of the action slide 14 along the magazine tube 6 toward the magazine 8 causes the shell drive assembly 16 to also be advanced rearwardly. The action slide 14 slides over the exterior surface of the cylindrical magazine tube 6, but is connected to the shell drive assembly 16 so as to cause the shell drive assembly 16 to traverse the interior of the magazine tube 6 in concert with the movement of the action slide 14. A slot may be formed within the magazine tube 6 to facilitate the attachment and movement of the action slide 14 and shell drive assembly 16. It should be recalled that the rearward movement of the action slide 14 actuates the shell ejection means as found in most shotguns, and further actuates the operation of the elevator 20 in loading the shell 10 into the firing chamber 18 as the action slide 14 is advanced to the forward position. In an automatic shotgun, gas pressure is used to actuate the shell drive assembly 16.

FIGS. 6 through 11 show the cycle of operation of the invention, beginning with the firing chamber 18 in an empty state as shown in FIG. 6. Shells 10*a, b, c* have been advanced to the top of the box magazine 8 and hood 5 by the spring biasing means 12, 30 of the magazine 8. The action slide 14 and shell drive assembly 16 are advanced to the full forward position, with the piston 26 of the shell drive assembly 16 being located forward of the shell 10*a* which has advanced to the top of the hood 5.

In FIG. 7, the action slide 14 begins to advance rearwardly, causing the shell drive assembly 16 to advance rearwardly as well. As the shell drive assembly 16 advances rearwardly, the piston 26 of the shell drive assembly 16 contacts the uppermost shell 10*a*.

In the preferred embodiment, the shell drive assembly 16 incorporates a cylinder 24 with a spring biased piston 26 protruding from one end thereof. As can be seen in FIG. 6, as the piston 26 contacts the shell 10*a*, the rate of travel of the piston 26 is slowed in comparison with the rate of travel of the cylinder 24, and accordingly, the spring 25 within the cylinder 24 is compressed as the length of the piston 26 enters the cylinder 24. It is not necessary that the shell drive assembly 16 be made up of a cylinder and spring biased piston; however, as will be pointed out, the invention performs in a superior manner as a result of using the spring biased piston 26 and cylinder 24 as disclosed in the drawings.

FIG. 8 shows the action slide 14 and shell drive assembly 16 as they reach the most rearward position. The length of the piston 26 is such that it has caused the shell 10*a* which it contacts to be advanced rearwardly even though the piston 26 is compressed into the cylinder 24. Accordingly, the shell 10*a* is advanced toward the loading chamber 22 and the elevator 20.

The spring tension on the piston 26 then causes the piston 26 to be expelled from the cylinder 24, forcing the shell 10*a* into the loading chamber 22 so as to be received by the elevator 20 which has moved to the full downward position in response to the action slide 14 being advanced toward the rear.

FIG. 9. The shell 10*a* is now positioned over the elevator 20 for loading into the firing chamber 18 by the means currently found in the prior art.

It should be noted in FIGS. 5 and 9 that the opening at the end of the cylinder 24 through which the piston 26 protrudes is a frusto-conical void, or other similar void, which will allow the piston 26 to "wobble" somewhat. As soon as shell 10*a* is removed from its position over shell 10*b*, shell 10*b* is advanced upwardly by the spring biasing means 12, 30 of the box magazine 8, causing shell 10*b* to contact the piston 26. Piston 26 is displaced somewhat in an upwardly fashion by shell 10*b* so that it no longer exactly parallel to the magazine tube 6 FIG. 9. While this feature is not absolutely necessary to the working of the device, it has been found that the shell drive assembly is less susceptible to jamming by the incorporation of this feature.

FIG. 10 shows the action slide 14 as it is advanced forwardly, which causes the elevator 20 to place the shell 10*a* into the firing chamber 18 by the means found in the prior art. The shell drive assembly 16 is seen being advanced forwardly by the movement of the action slide 14, with the piston 26 having substantially left the hood 5 and the remaining shells 10*b, c* having been advanced upwardly in magazine 8 into hood 5.

The action slide 14 has reached the full forward position in FIG. 11, and accordingly, the shell drive assembly 16 is again positioned as it was in FIG. 6, with the piston 26 located just forward of the shell 10*b* which has just reached the top of the box magazine 8 and hood 5. Shell 10*a* is in position in the firing chamber 18, and ready for firing.

The present invention provides a box magazine or cartridge which may be adapted to existing shotguns, manual or automatic, or may be designed into shotguns using the existing prevalent means of ejecting shells from the firing chamber and loading shells into the firing chamber. The advantage of a box magazine over the tube type magazine currently incorporated into the vast majority of repeating shotguns found in the prior art is that a greater number of shells may be placed into a box type magazine, and the shotgun may be reloaded by quickly detaching the empty magazine and attaching a replacement box type magazine, whereas the reloading of the tube type magazine is slow and cumbersome since each shell must be placed into the tube one at a time. Unloading of the shotgun is alsomade simpler since it is only necessary to remove the magazine, increasing safety over shotguns found in the prior art.

What is claimed is:

1. A box magazine and shell drive system for shotguns, comprising:

(a) a magazine which intersects a magazine tube of a shotgun, having a means which causes shells located within said magazine to be advanced into said magazine tube; and (b) a shell drive which traverses said magazine tube and which causes said shells which have been advanced into said magazine tube to be advanced into a firing chamber of said shotgun, wherein said shell drive comprises a cylinder having a spring biased piston located therein and protruding from a void at one end of said cylinder which will allow said piston to pivot, with said piston contacting a shell which has advanced into said magazine tube upon actuation of said shell drive so as to advance said shell for loading of said shell into said firing chamber.

2. A box magazine and shell drive system for shotguns as described in claim 1, wherein said magazine comprises a hood where said magazine intersects said magazine tube, and wherein said hood comprises a channel for aligning said shells as said shells approach said magazine tube, and which further comprises a cam surface which forces rearwardly a shell which has reached a top of said hood.

3. A box magazine and shell drive system for shotguns as described in claim 1, wherein said cylinder of said shell drive is attached to an action slide of said shotgun.

4. A box magazine and shell drive system for shotguns as described in claim 2, wherein said cylinder of said shell drive is attached to an action slide of said shotgun.

5. A box magazine and shell drive system for shotguns as described in claim 1, wherein said magazine has a hood which extends into said magazine tube, said hood having a radius approximately equal to that of said shell so as to receive said shell and protect and control said shell as said shell enters said magazine tube and as said shell is advanced into said firing chamber.

6. A box magazine and shell drive system for shotguns, comprising:

(a) a magazine intersecting a magazine tube of a shotgun having means therein for advancing a series of shells in sequence into said magazine tube; and (b) a shell drive which traverses said magazine tube so as to contact a shell which has entered said magazine tube and advance said shell for loading said shell into a firing chamber of said shotgun and which traverses said magazine tube in an opposite direction so as to withdraw from a point of intersection of said magazine tube and said magazine so as to allow next shell from said magazine to advance into said magazine tube, wherein said shell drive comprises a cylinder having a spring biased piston located therein and protruding from a void at one end of said cylinder which will allow said piston to pivot, with said piston contacting said shell which has advanced into said magazine tube upon actuation of said shell drive so as to advance said shell for loading of said shell into said firing chamber.

7. A box magazine and shell drive system for shotguns as described in claim 6, wherein said magazine comprises a hood where said magazine intersects said magazine tube, and wherein said hood comprises a channel for aligning shells as said shells approach said magazine tube, and which further comprises a cam surface which forces rearwardly a shell which has reached a top of said hood.

8. A box magazine and shell drive system for shotguns as described in claim 6, wherein said cylinder of said shell drive is attached to an action slide of said shotgun.

9. A box magazine and shell drive system for shotguns as described in claim 7, wherein said cylinder of said shell drive is attached to an action slide of said shotgun.

10. A box magazine and shell drive system for shotguns as described in claim 6, wherein said magazine has a hood thereon having a radius approximately equal to said shell so as to protect and control said shell as it enters said magazine tube and as it is advanced into said firing chamber.

* * * * *